US008194028B2

(12) United States Patent
Fletcher et al.

(10) Patent No.: US 8,194,028 B2
(45) Date of Patent: Jun. 5, 2012

(54) SYSTEM AND METHOD FOR ADJUSTING AN INTENSITY VALUE AND A BACKLIGHT LEVEL FOR A DISPLAY OF AN ELECTRONIC DEVICE

(75) Inventors: Bergen Albert Fletcher, Kitchener (CA); James Robinson, Elmira (CA); Conrad Aleksander Kreek, Waterloo (CA); David Mak-Fan, Waterloo (CA); Andrew Dewi Williams, Kanata (CA); Michael Purdy, Kitchener (CA)

(73) Assignee: Research In Motion Limited, Waterloo, Ontario (CA)

( * ) Notice: Subject to any disclaimer, the term of this patent is extended or adjusted under 35 U.S.C. 154(b) by 858 days.

(21) Appl. No.: 12/039,905

(22) Filed: Feb. 29, 2008

(65) Prior Publication Data

US 2009/0219244 A1 Sep. 3, 2009

(51) Int. Cl.
*G09G 3/36* (2006.01)

(52) U.S. Cl. ..... 345/102; 345/690

(58) Field of Classification Search ..... 345/102, 345/89, 690, 603, 604; 349/61–70; 362/561
See application file for complete search history.

(56) References Cited

U.S. PATENT DOCUMENTS

| | | | | |
|---|---|---|---|---|
| 5,841,904 | A * | 11/1998 | Sugiura | 382/233 |
| 6,137,533 | A | 10/2000 | Azim | |
| 7,064,781 | B1 | 6/2006 | Lovette et al. | |
| 7,176,878 | B2 * | 2/2007 | Lew et al. | 345/102 |
| 7,995,027 | B2 * | 8/2011 | Hong | 345/102 |
| 2001/0033260 | A1 * | 10/2001 | Nishitani et al. | 345/87 |
| 2004/0227697 | A1 * | 11/2004 | Mori | 345/30 |
| 2004/0257318 | A1 * | 12/2004 | Itoh | 345/87 |
| 2005/0104840 | A1 | 5/2005 | Sohn et al. | |
| 2005/0225983 | A1 * | 10/2005 | Fornell | 362/276 |
| 2007/0080975 | A1 * | 4/2007 | Yamashita et al. | 345/591 |
| 2007/0092139 | A1 | 4/2007 | Daly | |
| 2007/0216616 | A1 * | 9/2007 | Stessen et al. | 345/84 |
| 2008/0180385 | A1 * | 7/2008 | Yoshida et al. | 345/102 |

FOREIGN PATENT DOCUMENTS

| | | | |
|---|---|---|---|
| EP | 1111578 | A1 | 6/2001 |
| EP | 1818901 | A1 | 8/2007 |
| WO | WO 2005/109391 | A1 | 11/2005 |

OTHER PUBLICATIONS

De Greef, Pierre and Hendriek Groot Hulze. Adaptive Dimming and Adaptive Boosting Backlight Technologies for LCD-TV Systems. Digital TV Designline. Nov. 14, 2007. http://www.embedded.com/columns/technicalinsights/203100244.

* cited by examiner

*Primary Examiner* — Chanh Nguyen
*Assistant Examiner* — Ram Mistry
(74) *Attorney, Agent, or Firm* — McCarthy Tetrault LLP

(57) ABSTRACT

The disclosure relates to a system and method for determining pixel intensity values (luma values) for an image being displayed on a display of an electronic device, then adjusting the pixel intensity and the backlight level for the image that is output to a liquid crystal display (LCD). The system comprises: a display for displaying an image to be displayed on the device; an image adjustment module to identify the pixel intensity values of the image, to determine new pixel intensity values for the image based in part on the original pixel intensity values, to provide the (adjusted) image at the new pixel intensity values to the display and to determine a backlight level for the image at the new pixel intensity values. The system further comprises a backlight system to provide a backlight for the adjusted image at the adjusted backlight level.

16 Claims, 6 Drawing Sheets

Fig. 4

```
//assume all RGB and intensity values are unsigned 8-bit (i.e. a value from 0-255)

Define Number_Of_Pixels_On_Display = Display_Height_Pixels * Display_Width_Pixels;
//reset the histogram bins to zeros
For i = 0 to 255
                intensity_histogram[i] = 0;
For i = 0 to (Number_Of_Pixels_On_Display - 1)
                red_pixel_value = GetRedPixelValueFromBuffer(i);
                green_pixel_value = GetGreenPixelValueFromBuffer(i);
                blue_pixel_value = GetBluePixelValueFromBuffer(i);
                //assume that all RGB pixel values are 8 bit (i.e. 0-255)
                pixel_intensity_value = (33*red_pixel_value)/100 + (59*green_pixel_value)/100 +
                (11*blue_pixel_value)/100;
                intensity_histogram[pixel_intensity_value]++;  //increment the correct bin in the
                intensity histogram;
                i += pixel_increment;  //increment pixel counter (pixel_increment = 1 if analyzing
                every pixel, = 2 if analyzing every second pixel, etc.)
                number_of_pixels_in_histogram++;  //increment histogram size

pixel_intensity_top_down_cumulative = 0;
number_of_pixels_to_clip = (percent_pixels_to_clip * number_of_pixels_in_histogram)/100);
//assume percent_pixels_to_clip is an integer 0-100, i.e. if pecent_pixels_to_clip = 90, then 90% of
the pixels in the original image will multiplied by a gain which results in a value greater or equal to
255
//assume 8 bit
For i = 255 to 0
                pixel_intesity_top_down_cumulative += intensity_histogram[i];  //add to the
                cumulative sum of pixels starting with bin 255 and counting down
                //check to see if number cumulative pixels equals or exceeds
                //the number of pixels to be clipped
                if (pixel_intensity_top_down_cumulative >= number_of_pixels_to_clip)
                                break;  //i.e. end for loop
                                i--; decrement histogram counter


pixel_gain = (255*100)/i;          //calculate the gain to apply to the image RGB values to
                                   //increase image intensity, pixel_gain is actually the desired gain
                                   // x 100 to avoid use of decimals and floating point arithmetic

ApplyGainToAllRGBValuesInBuffer(pixel_gain);

new_backlight_percent = (max_backlight_percent * 100) / (pixelGain * pixelGain);
                //new_backlight_percent and max_backlight_percent are integer values 0-100,
                // max_backlight_percent would be determined by another algorithm in the system
//                i.e. ambient light sensor, user settings, etc.

SetDisplayBacklightPerecnt(new_backlight_percent);
```

Fig. 5

SYSTEM AND METHOD FOR ADJUSTING AN INTENSITY VALUE AND A BACKLIGHT LEVEL FOR A DISPLAY OF AN ELECTRONIC DEVICE

The disclosure herein describes a system and method for controlling and adjusting a backlight level for a display on an electronic device. In particular, the disclosure relates to controlling the backlight level by determining an intensity of an image being shown or to be shown on the display and adjusting an image intensity and backlight values in view of the determined intensity.

BACKGROUND OF THE INVENTION

Current wireless handheld mobile communication devices perform a variety of functions to enable mobile users to stay current with information and communications, such as e-mail, corporate data and organizer information while they are away from their desks. A wireless connection to a server allows a mobile communication device to receive updates to previously received information and communications.

The handheld devices optimally are lightweight, compact and have long battery life. A display and its backlight when powered typically are significant sources of major power drains on the power source (e.g. batteries) of current devices.

There is a need for a system and method which addresses deficiencies in the prior art.

BRIEF DESCRIPTION OF THE DRAWINGS

The invention will now be described, by way of example only, with reference to the accompanying drawings, in which:

FIG. 5 is an extract of exemplary pseudocode to implement the algorithm of FIG. 4.

DETAILED DESCRIPTION OF AN EMBODIMENT

Figure 1:
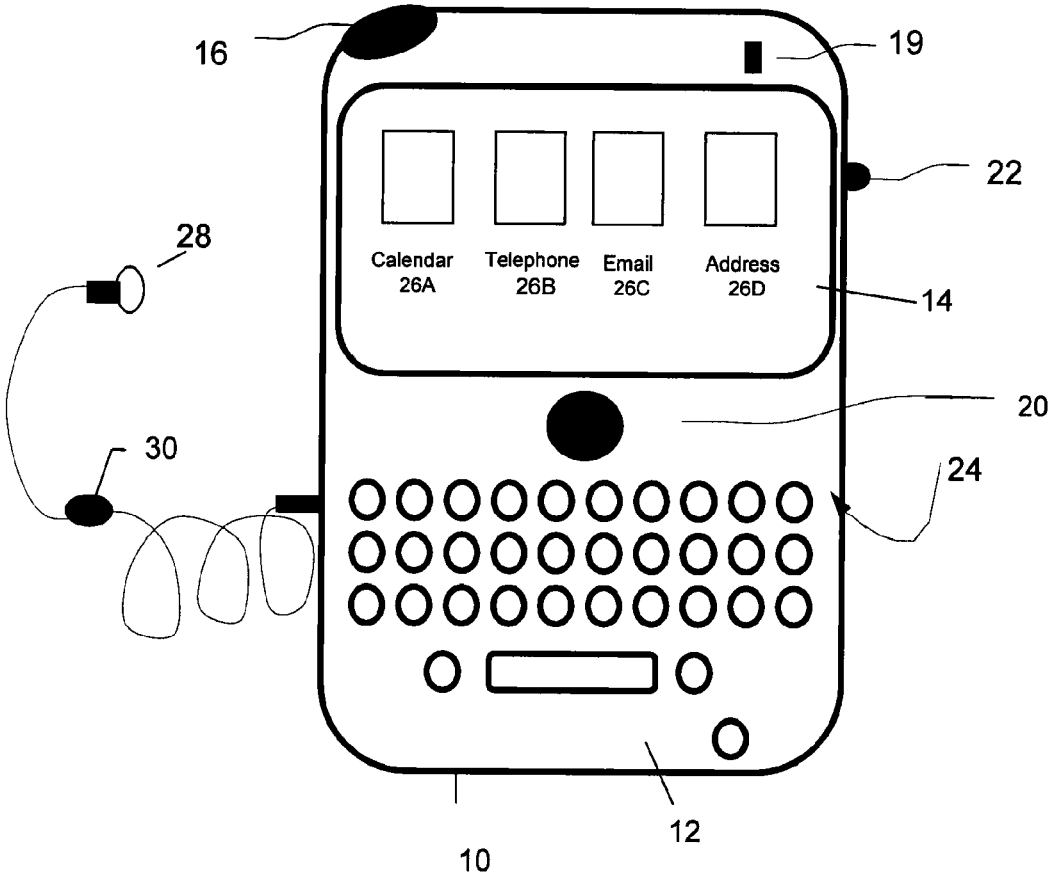
FIG. 1 is a schematic representation of an electronic device having a display and an image/background adjustment system for the display in accordance with an embodiment.

The description which follows and the embodiments described therein are provided by way of illustration of an example or examples of particular embodiments of the principles of the present disclosure. These examples are provided for the purposes of explanation and not limitation of those principles and of the disclosure. In the description which follows, like parts are marked throughout the specification and the drawings with the same respective reference numerals.

In a first aspect of an embodiment, a system for an electronic device is provided. The system may be a backlight system. The system comprises: a display for displaying an image on the device; an image adjustment module to identify one or more pixel intensity values of the image, to determine a new (increased) intensity value for the image based in part on the original pixel intensity values, to provide the image at the new pixel intensity values to said display, and to determine a backlight level for the image at the new pixel intensity values; and a backlight system to provide a backlight for the display, where the backlight system provides the backlight at the determined backlight level.

In the image adjustment module, it may be further configured to determine the new pixel intensity values by utilizing data relating to a distribution of the original pixel values.

The system may be further configured to determine the new pixel intensity values by calculating the new pixel intensity values. For example, the pixel intensity value may be determined either by a calculation conducted by the image adjustment module or by data being provided to the image adjustment module.

In the system, the image adjustment module may utilize a gain factor to determine the new pixel intensity values.

In the system, the gain factor may be set depending on an overall intensity value for the image.

In the system, the image adjustment module may utilize an offset factor to determine the new intensity value.

In the system, the backlight level may be set lower for the image of the new pixel intensity values than an original backlight level for the image of the original pixel intensity values.

In the system, the backlight level may be maintained for the display for a predetermined length of time.

In the system, the backlight level may be maintained for the display after a different image is provided to the display.

In the system, the average intensity may be calculated from pixel intensity values associated with the image and the pixel intensity values may have been adjusted according to a gamma curve.

In the system, the average intensity may be calculated on a running average basis of pixels in the image.

In the system, the pixel intensity values may provide a weight to favour green colours in the image. Other colour(s) may be alternatively or additionally favoured.

In the system, another calculation may be made for another pixel intensity values for another image when the image is replaced on the display.

In the system, another calculation may be made for another pixel intensity value for another image when the image is replaced by another image and if another image has changes over the image over more than a small portion or predefined portion of the display.

The system may further comprise a light detector, where at least one of the pixel intensity values and the backlight level may be adjusted to account for ambient light conditions for the device.

In the system, the gain factor may be applied to the image through the use of an overlay.

In the system, the gain factor may be determined from an intensity calculation for pixels within a predetermined area in the image.

In a second aspect, a method of adjusting a backlight for a display for an electronic device is provided. The method comprises: calculating and or identifying the pixel intensity value(s) of an image; determining new (increased) intensity value(s) for the image based in part on the original pixel intensity value(s); determining a backlight level for the image at the new pixel intensity value; and providing the backlight level to a backlight system for a display when the new image is generated on the display. In the method, the pixel intensity value may represent an average intensity of the image.

In the method, the pixel intensity value may provide a weight to favour green colours in the image. Other colour(s) may be alternatively or additionally favoured.

In the method, another calculation and/or identification may be made for another set of pixel intensity values for another image when the image is replaced by the another image on the display. In the method, another calculation and/or identification may be made for another set of pixel intensity values for another image when the image is replaced by the another image and if the another image has changes over the image over more than a small or predefined portion.

In the method, the display may be displaying a video image comprising the image and another image; and another calculation may made for another pixel intensity values for another image shown on the display after the image.

In the method, the pixel intensity values and/or backlight level may be adjusted to account for ambient light conditions for the device.

In the method, the gain factor may be determined from an intensity calculation for pixels within a predetermined area in the image.

In other aspects, various sets and subsets of the above noted aspects are provided.

Referring to FIG. 1, an electronic device for receiving electronic communications in accordance with an embodiment of the invention is indicated generally at 10. In the present embodiment, electronic device 10 is based on a computing platform having exemplary functionality of an enhanced personal digital assistant such as cellphone, e-mail, photographic and media playing features. It is, however, to be understood that electronic device 10 can be based on construction design and functionality of other electronic devices, such as smart telephones, desktop computers pagers or laptops having telephony equipment. In a present embodiment, electronic device 10 includes a housing 12, a display 14 (which may be a liquid crystal display or LCD), speaker 16, a light emitting diode (LED) indicator 19, a trackball 20, a trackwheel (not shown), an ESC ("escape") key 22, keypad 24, a telephone headset comprised of an ear bud 28 and a microphone 30. Trackball 20 and ESC key 22 can be inwardly depressed as a means to provide additional input signals to device 10.

It will be understood that housing 12 can be made from any suitable material as will occur to those of skill in the art and may be suitably formed to house and hold all components of device 10.

Device 10 is operable to conduct wireless telephone calls, using any known wireless phone system such as a Global System for Mobile Communications ("GSM") system, Code Division Multiple Access ("CDMA") system, Cellular Digital Packet Data ("CDPD") system and Time Division Multiple Access ("TDMA") system. Other wireless phone systems can include Bluetooth and the many forms of 802.11 wireless broadband, like 802.11a, 802.11b, 802.11g, etc. that support voice. Other embodiments include Voice over IP (VoIP) type streaming data communications that can simulate circuit switched phone calls. Ear bud 28 can be used to listen to phone calls and other sound messages and microphone 30 can be used to speak into and input sound messages to device 10.

Various applications are provided on device 10, including email, telephone, calendar and address book applications. A graphical user interface (GUI) providing an interface to allow entries of commands to activate these applications is provided on display 14 through a series of icons 26. Shown are calendar icon 26A, telephone icon 26B, email icon 26C and address book icon 26D. Such applications can be selected and activated using the keypad 24 and/or the trackball 20. Further detail on selected applications is provided below.

Figure 2:
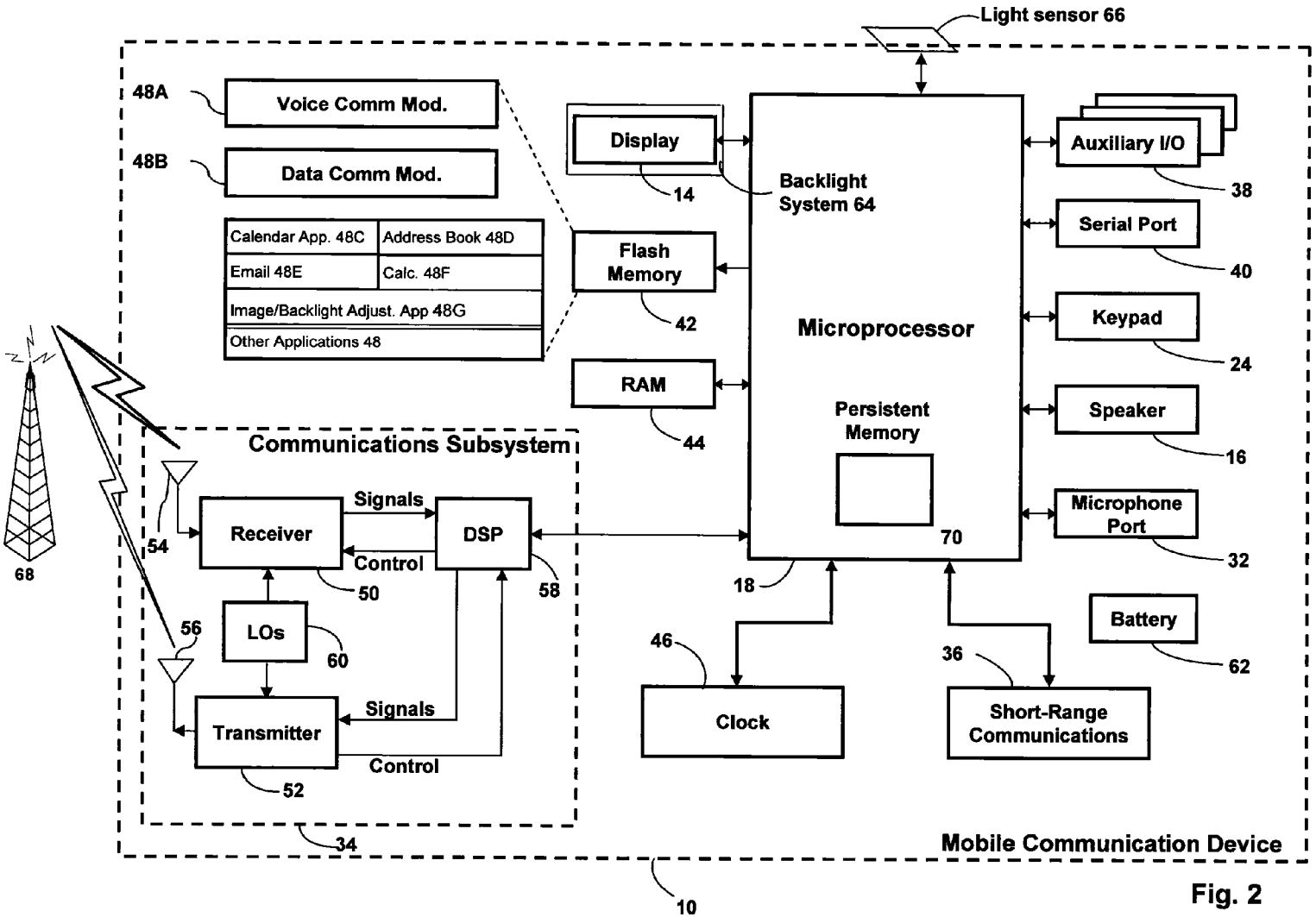
FIG. 2 is a block diagram of internal components of the device of FIG. 1 including the display and the image/background adjustment system.

Referring to FIG. 2, functional elements of device 10 are provided. The functional elements are generally electronic or electromechanical devices. In particular, microprocessor 18 is provided to control and receive almost all data, transmissions, inputs and outputs related to device 10. Microprocessor 18 is shown schematically as coupled to keypad 24, display 14 and other internal devices. Microprocessor 18 controls the operation of the display 14, as well as the overall operation of the device 10, in response to actuation of keys on the keypad 24 by a user. Exemplary microprocessors for microprocessor 18 include microprocessors in the Data 950 (trademark) series, the 6200 series and the PXA900 series, all available at one time from Intel Corporation.

In addition to the microprocessor 18, other internal devices of the device 10 include: a communication subsystem 34; a short-range communication subsystem 36; keypad 24; and display 14; with other input/output devices including a set of auxiliary I/O devices through port 38, a serial port 40, a speaker 16 and a microphone port 32 for microphone 30; as well as memory devices including a flash memory 42 (which provides persistent storage of data) and random access memory (RAM) 44; clock 46 and other device subsystems (not shown). The device 10 is preferably a two-way radio frequency (RF) communication device having voice and data communication capabilities. In addition, device 10 preferably has the capability to communicate with other computer systems via the Internet.

Operating system software executed by microprocessor 18 is preferably stored in a computer readable medium, such as flash memory 42, but may be stored in other types of memory devices (not shown), such as read only memory (ROM) or similar storage element. In addition, system software, specific device applications, or parts thereof, may be temporarily loaded into a volatile storage medium, such as RAM 44. Communication signals received by the mobile device may also be stored to RAM 44.

Microprocessor 18, in addition to its operating system functions, enables execution of software applications on device 10. A set of software applications 48 that control basic device operations, such as a voice communication module 48A and a data communication module 48B, may be installed on the device 10 during manufacture or downloaded thereafter.

Communication functions, including data and voice communications, are performed through the communication subsystem 34 and the short-range communication subsystem 36. Collectively, subsystem 34 and subsystem 36 provide the signal-level interface for all communication technologies processed by device 10. Various other applications 48 provide the operational controls to further process and log the communications. Communication subsystem 34 includes receiver 50, transmitter 52 and one or more antennas, illustrated as receive antenna 54 and transmit antenna 56. In addition, communication subsystem 34 also includes processing module, such as digital signal processor (DSP) 58 and local oscillators (LOs) 60. The specific design and implementation of communication subsystem 34 is dependent upon the communication network in which device 10 is intended to operate. For example, communication subsystem 34 of the device 10 may be designed to work with one or more of a Mobitex (trademark) Radio Network ("Mobitex") and the DataTAC (trademark) Radio Network ("DataTAC"). Voice-centric technologies for cellular device 10 include Personal Communication Systems (PCS) networks like Global System for Mobile Communications (GSM) and Time Division Multiple Access (TDMA) systems. Certain networks provide multiple systems. For example, dual-mode wireless networks include Code Division Multiple Access (CDMA) networks, General Packet Radio Service (GPRS) networks, and so-called third-generation (3G) networks, such as Enhanced Data rates for Global Evolution (EDGE) and Universal Mobile Telecommunications Systems (UMTS). Other network communication technologies that may be employed include, for example, Ultra Mobile Broadband (UMB), Evolution-Data Optimized (EV-DO), and High Speed Packet Access (HSPA), etc.

In addition to processing communication signals, DSP 58 provides control of receiver 50 and transmitter 52. For example, gains applied to communication signals in receiver 50 and transmitter 52 may be adaptively controlled through automatic gain control algorithms implemented in DSP 58.

In a data communication mode a received signal, such as a text message or web page download, is processed by the communication subsystem 34 and is provided as an input to microprocessor 18. The received signal is then further processed by microprocessor 18 which can then generate an output to the display 14 or to an auxiliary I/O port 38. A user may also compose data items, such as e-mail messages, using keypad 24, trackball 20, or a thumbwheel (not shown), and/or some other auxiliary I/O device connected to port 38, such as a touchpad, a rocker key, a separate thumbwheel or some other input device. The composed data items may then be transmitted over communication network 68 via communication subsystem 34.

In a voice communication mode, overall operation of device 10 is substantially similar to the data communication mode, except that received signals are output to speaker 16, and signals for transmission are generated by microphone 30. Alternative voice or audio I/O subsystems, such as a voice message recording subsystem, may also be implemented on device 10.

Short-range communication subsystem 36 enables communication between device 10 and other proximate systems or devices, which need not necessarily be similar devices. For example, the short-range communication subsystem may include an infrared device and associated circuits and components, or a Bluetooth (trade-mark) communication module to provide for communication with similarly-enabled systems and devices.

Powering the entire electronics of the mobile handheld communication device is power source 62 (shown in FIG. 2 as "battery"). Preferably, the power source 62 includes one or more batteries. More preferably, the power source 62 is a single battery pack, especially a rechargeable battery pack. A power switch (not shown) provides an "on/off" switch for device 10. Upon activation of the power switch an application 48 is initiated to turn on device 10. Upon deactivation of the power switch, an application 48 is initiated to turn off device 10. Power to device 10 may also be controlled by other devices and by internal software applications.

Display 14 has backlight system 64 to assist in the viewing display 14, especially under low-light conditions. A backlight system is typically present in a LCD. A typical backlight system comprises a lighting source, such as a series of LEDs or a lamp located behind the LCD panel of the display, and a controller to control activation of the lighting source. The lamp may be fluorescent, incandescent, electroluminescent or any other suitable light source known to a person of skill in the art. As the lighting sources are illuminated, their light shines through the LCD panel providing backlight to the display. The intensity of the backlight level may be controlled by the controller by selectively activating a selected number of lighting sources (e.g. one, several or all LEDs) or by selectively controlling the activation duty cycle of the activated lighting sources (e.g. a duty cycle anywhere between 0% to 100% may be used). As will be described in more detail below, backlight system 64 can be made responsive to signals from a software module that determines a new intensity value for an image.

To assist with one method of adjusting the backlight level, light sensor 66 is provided on device 10. Sensor 66 is a light sensitive device which converts detected light levels into an electrical signal, such as a voltage or a current. It may be located anywhere on device 10, having considerations for aesthetics and operation characteristics of sensor 66. In one embodiment, an opening for light to be received by sensor 66 is located on the front cover of the housing of device 10 to reduce the possibility of blockage of the opening. In other embodiments, multiple sensors 66 may be provided and the software may provide different emphasis on signals provided from different sensors 66. The signal(s) provided by sensor(s) 66 can be used by a circuit in device 10 to determine when device 10 is in a well-lit, dimly lit or moderately-lit environment. This information can then be used to control backlight levels for display 14. It will be appreciated that a number of discrete ambient lighting levels may be recognized by sensor(s) 66. Progressions between levels may or may not be separated by a constant change in lighting intensity. In some embodiments, LED indicator 19 may be also used as a light sensor.

Brief descriptions are provided on the applications 48 stored and executed in device 10. Voice communication module 48A and data communication module 48B have been mentioned previously. Voice communication module 48A handles voice-based communication such as telephone communication, and data communication module 48B handles data-based communication such as e-mail. In some embodiments, one or more communication processing functions may be shared between modules 48A and 48B. Additional applications include calendar 48C which tracks appointments and other status matters relating to the user and device 10. Calendar 48C is activated by activation of calendar icon 26A on display 14. It provides a daily/weekly/month electronic schedule of appointments, meetings and events entered by the user. Calendar 48C tracks time and day data for device 10 using processor 18 and internal clock 46. The schedule contains data relating to the current accessibility of the user. For example it can indicate when the user is busy, not busy, available or not available. In use, calendar 48C generates input screens on display 14 prompting the user to input scheduled events through keypad 24. Alternatively, notification for scheduled events could be received via an encoded signal in a received communication, such as an e-mail, SMS message or voicemail message. Once the data relating to the event is entered, calendar 48C stores processes information relating to the event; generates data relating to the event; and stores the data in memory in device 10.

Address book 48D enables device 10 to store contact information for persons and organizations. Address book 48D is activated by activation of address book icon 26D on display 14. Names, addresses, telephone numbers, e-mail addresses, cellphone numbers and other contact information is stored. The data can be entered through keypad 24 and is stored in an accessible database in non-volatile memory, such as persistent storage 70 or flash memory 42, which are associated with microprocessor 18, or any other electronic storage provided in device 10. Persistent memory 70 may a separate memory system to flash memory 42 and may be incorporated into a device, such as in microprocessor 18. Additionally or alternatively, memory 70 may be removable from device 10 (e.g.

such as a SD memory card), whereas flash memory 42 may be permanently connected to device 10.

Email application 48E provides modules to allow user of device 10 to generate email messages on device 10 and send them to their addressees. Application 48E also provides a GUI which provides a historical list of emails received, drafted, saved and sent. Text for emails can be entered through keypad 24. Email application 48E is activated by activation of email icon 26C on display 14.

Calculator application 48F provides modules to allow user of device 10 to create and process arithmetic calculations and display the results through a GUI.

Image/Backlight adjustment application 48G (which may also be called an image adjustment module) is an image processing module and includes instructions that assist in processing an image that is about to be displayed on display 14 by analyzing the one or more pixels comprising the image for their intensity value(s). Based on the pixel intensity values, one or more of a backlight level and a pixel intensity adjustment value can be calculated and set for the image and/or the backlight level. As such, when the image is actually displayed on display 14, one or more of the pixel intensity values of the image can be adjusted and/or the backlight level can be set for the image. Image/Backlight adjustment application 48G can generate an appropriate signal, such as a pulse width modulation (PWM) signal or values for a PWM signal, that can be used to drive a backlight in backlight system 64 to an appropriate level. If backlight system 64 utilizes a duty cycle signal to determine a backlight level, application 48G can be modified to provide a value for such a signal, based on inputs received. Further detail on calculations conducted by application 48G are provided below.

Further detail is now provided on notable aspects of an embodiment. An embodiment provides a system and method for dynamically adjusting one or more of the intensity of an image and/or the lighting intensity of the backlight on display 14 for the image. As a display and its backlight system tend to consume a large percentage of power of a handheld device 10, by adjusting the backlight level to the intensity of the new image, this can increase battery life for device 10. Backlight system 64 provides the lighting means to vary the intensity of the backlight provided to display 14. Image/Backlight adjustment application 48G provides the software that controls the intensity of one or more of the image generated on display 14 and the backlight using various data and signals available to device 10 relating to the colour and intensity data of the image that is meant to be the image generated on display 14.

It will be appreciated that an image that is to be generated on display 14 is stored on device 10 as data. As is common in bit-mapped images, a pixel on display 10 can be "lit" in one of a palette of colours, with a palette of intensities, where the colour and intensity values set for that pixel represents one pixel corresponding to the image.

One algorithm provided by the embodiment, which may be conducted and/or processed by image adjustment module 48G, includes identifying the pixel intensity values of the image. The algorithm may also include making a determination of the intensity values of an image currently being displayed, then adjusting the pixel intensity values for the pixels in the image and providing the image at the new pixel intensity values for presentation on display 14. The new intensity value may be determined by utilizing data relating to a distribution of the original pixel values. The distribution may related to any known or preset statistical or data model. An adjustment typically is an increase in the pixel intensity values in view of additional detected "headroom" for an intensity adjustment, i.e. a range of available pixel values for the intensity adjustment. Finally, the algorithm may generate the new image on the display and may adjust a backlight level for the new image. The backlight adjustment is typically a decrease in the backlight level from the original backlight level set for the original image. The display would then have the new image being generated thereon (having an increased pixel intensity levels from the original image) with a new backlight level (having a decreased backlight level from the original backlight level). The resulting net intensity of the new image with the new backlight level is meant to be comparable in viewed intensity level to the net intensity of the original image with the original (unadjusted) backlight level. The new pixel intensity levels for the image may be based on any type of intensity reading determined for the image. For example, an average intensity reading can be determined. Various types of averages can be used. Details of each are described in turn.

The embodiment utilizes difference in perceived brightness level in a displayed image versus the actual brightness level of the image. For example, an image having many dark pixels may appear to be less bright than an image having many lighter pixels. This apparent brightness level difference occurs because the liquid crystal in an LCD generally allows more light to pass through lighter pixels and less light passes through darker pixels. In an idealized image, all light would pass through a completely white image and no light would pass through a completely black image.

Figure 3:
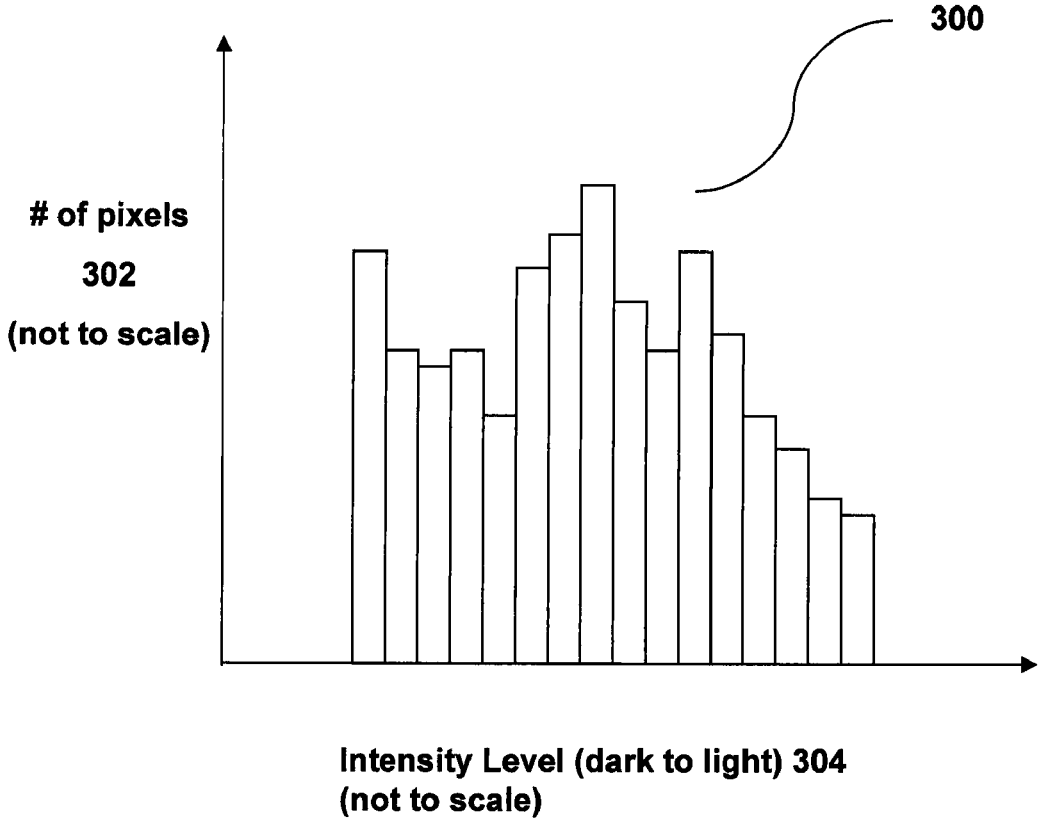
FIG. 3 is an exemplary histogram of pixel intensity values for an image being analyzed by the image/backlight adjustment system of FIG. 1.

Referring to FIG. 3, in determining the intensity of a displayed image, one distribution model for the data is a histogram calculation that may be obtained to calculate a brightness value for at least a part of the image. As is known in the art, exemplary histogram 300 may be created for images in a graph where a count is on the y-axis 302 and a brightness value (from dark to bright) is charted on the positive x-axis 304. Each pixel's brightness in the image is added to each brightness value in the x-axis. The resulting graph provides a graphical indication of the distribution of the intensity levels in an image from the darker pixels to the brighter pixels. If an image is generally dark (by whatever parameters are set for an embodiment), the image's histogram would chart a larger number of darker pixels (on the left side of the histogram) compared to the number of brighter pixels. Histogram 300 shows that there are more darker pixels, generally, than lighter pixels. Conversely, a brighter image may have a histogram where there are more lighter pixels (on the right side of the histogram) compared to the number of darker pixels. It will be appreciated that the terms "lighter" and "darker" are relative terms.

It will be appreciated that different values may be provided along the x-axis in a histogram. For example, the intensity scale may be truncated at either end; the scale may be linear or non-linear in sections through the x-axis; also there may be step-wise jumps in intensities at one or more points in the x-axis. Other discontinuities or non-linear progressions may be provided.

The data for a histogram may be stored in a datastructure, such as a table in any of the memory storage devices of device 10, such as flash memory 42, RAM 44 and/or persistent memory 70. The data may be processed by any application having access thereto. The histogram may track intensity values (luma values) for the pixels of the image, where each of red, green, and blue components pixel may (or may not) be converted to a greyscale or luma equivalent (using any conversion algorithm known to those of skill in the art). Some algorithms may use equal weighting for each red, green and blue pixel intensity values. Other algorithms may use different weighting. Additionally or alternatively, a histogram can be created for each component colour (red, green, blue— known by the acronym "RGB") of a pixel and a composite colour intensity histogram can be determined for that image.

Intensity is based on a brightness value associated with a pixel. For example, a greyscale pixel may have an intensity value ranging from 0 (black) to 255 (pure white) in an eight-bit scale. Each colour component may be plotted on a similar intensity scale. However, it will be appreciated that a "pure" colour (e.g. green) at a given numeric intensity may be brighter (or darker) than a different pure colour (e.g. red) that is generated at the same numeric intensity value. In other words, a green pixel of the same numeric intensity value as a red pixel may have a larger luma value.

Once a histogram (or an equivalent datastructure) is created for an image, the luma values can be calculated on at least a portion of pixels comprising the image. The histogram data (or other data) indicates how much an image utilizes the full range of luma values. The intensity, or luma, may be increased on a per (RGB) colour value. The luma values for all pixels or a selection of pixels, may be changed via a gain factor (generally by multiplying by the gain factor) or an offset factor (generally by adding the offset factor) or a combination of both. Per RGB component colour, the adjustment to its luma value may be the same or different than the adjustment made to its related colours for that pixel. Appropriate gain or offset factors may be determined based upon the overall intensity value for the image. For example, a "dark" image may not have more than 10% of its intensity values greater than 127 (on an intensity scale of 0 to 255). As such, if it is visually acceptable to clip an amount of intensity, e.g. saturate the highest 10% of pixels to 255, then a gain of 2 may be applied to the all pixel values in the image, as 2 times 127=254 will still be within the highest value of the luma range.

As such, for setting a threshold, a percentage or threshold value is needed to identify what percentage of pixels are to be clipped.

One exemplary algorithm which may be implemented to determine a percentage is to analyze all or part of the histogram and determine the maximum pixel value that can be multiplied to the maximum bit value (e.g. 255 in an 8 bit intensity scale). For example, if the threshold to is set to clip 10% of the pixels, then the pixel value (x) needs to be identified below which 90% of the total number of pixels lie in the histogram. The gain would then be equal to maximum bit value/the pixel value, namely:

$$\text{Luma gain} = \text{maximum bit value}/x \qquad \text{Equation 1}$$

Another exemplary algorithm is to calculate the average luma and standard deviation of the luma of the image. Then the luma gain of the image may be determined by a number of standard deviations (or other statistical measures) that are desired to be preserved within the image. In this case:

$$\text{Luma gain} = \text{maximum bit value}/(\text{average luma value} + k * std_dev), \text{ where } k \text{ is the "threshold" or the number of standard deviations to be preserved} \qquad \text{Equation 2}$$

For a Gaussian distribution, 97% of pixel values would be within three standard deviations from the average luma value. As such, k=2 or 3 may be an appropriate value.

Utilizing a constant (or near constant) gain factor for the luma values provides an advantage of preserving the darkness values of darker pixels. It will be appreciated that another algorithm would be to not apply any gain and/or offset (or provide a limited gain and/or offset) to pixels having an original darkness value that is below a predetermined threshold.

With the pixel intensities of the image increased, an embodiment can reduce the amount of backlight provided to it, thereby using less battery power than if the original stronger backlight level were used. Using at least part of the luma calculations provided for the image, the intensity (or brightness) of a backlight is dynamically calculated and may be lowered. The intensity can be adjusted as different images are displayed on display 14.

Figure 4:
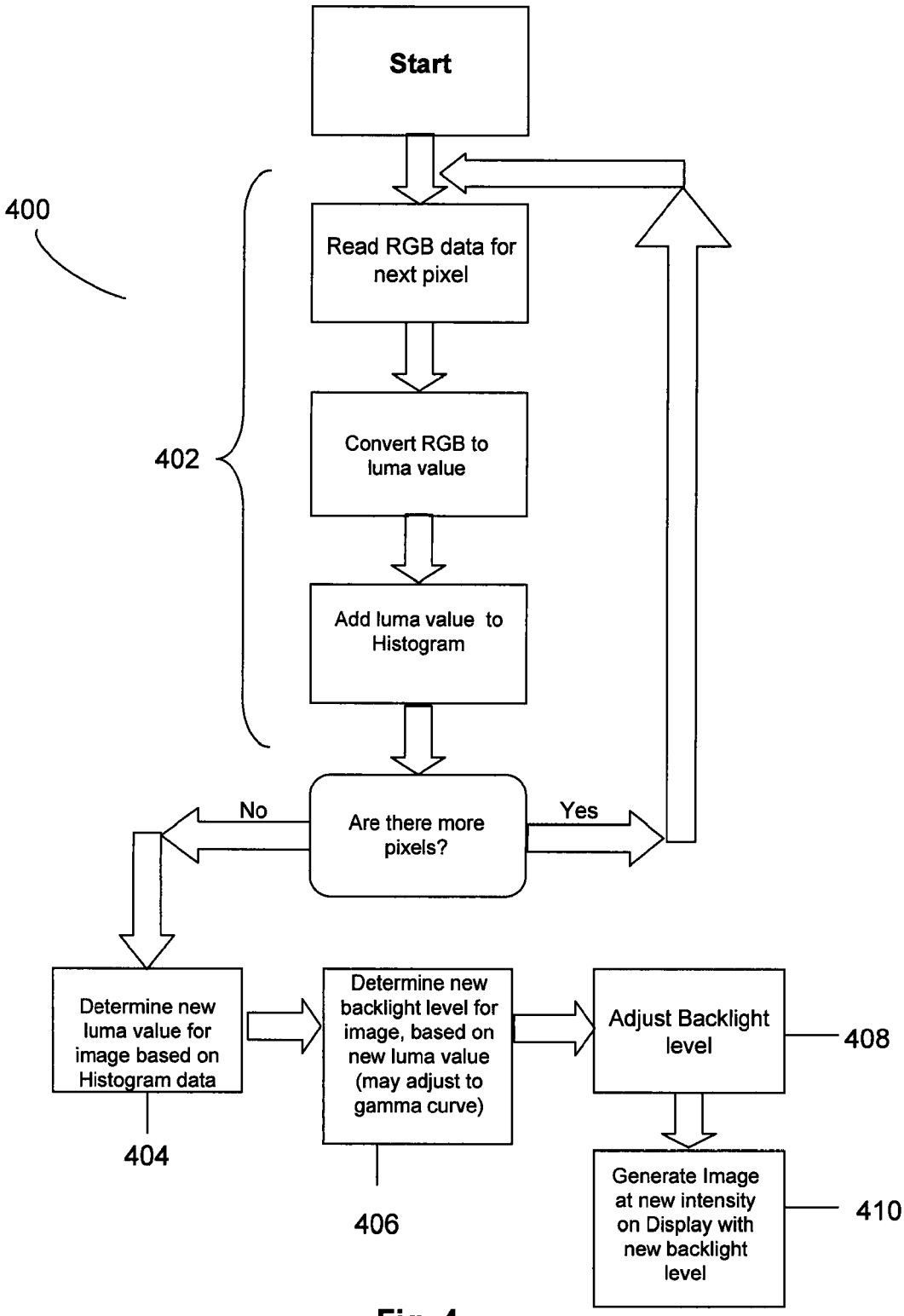
FIG. 4 is a flow chart of an algorithm executed by the image/backlight adjustment system of FIG. 1.

Referring to FIG. 4, further detail is provided on an exemplary calculation conducted by module 48G. Therein algorithm 400 comprises the above noted three main operations: calculate or otherwise determine pixel intensity value(s) for an image in section 402; adjust the pixel intensity values of selected portion(s) of the image, based in part on the determined pixel luma value(s) in section 404; determine an adjustment value for the backlight, based on the increase in luma of the pixels comprising the image in section 406; adjust the backlight values in section 408; display the adjusted image set at the determined pixel luma values and display the image in section 410. Each section is described in turn.

For section 402, an embodiment provides an algorithm implemented in software that executes on device 10 that calculates luma values for the pixels comprising an image being generated on display 14. As noted, the pixel intensity may be calculated on a colour basis, using the intensities of the respective R, G and B values of each pixel in the image. As the display 14 generates images in colour, in order to provide a luma value for the pixels comprising the image that can be compared against other luma values for other images, it is preferable to convert the colour values to a single pixel intensity (luma) value for each pixel comprising the image. For example, in a given image, a pixel that is green at a given pixel value is more luminous than a pixel that is red at the same pixel value. By converting all colour values for all pixels to a pixel luma value, such differences may be smoothed out, since during the conversion process, the luminosity of different colours is preferably taken into consideration.

Further detail is provided on a pixel luma calculation. Pixel luma values may be calculated as the image is read from memory or as the image is being written to the display 14. The pixel luma may be derived from a photopic curve based calculation which combines three colour pixels (i.e. red, green and blue) into a single value. This may (or may not) be a greyscale value. The average may be calculated on a running average basis, in order to minimize the processing of large numbers. As an image is being read from memory or as it is being written to the display the value of each pixel is computed into the running average. A conventional method of calculating an average is to first sum luma values of all the pixels in an image and then divide by the total number of pixels. This computational method introduces large numbers in the calculation method. As an alternative, an embodiment preferably sequentially adds a pixel value to a running average total. After every pixel value has been added to the total, the average value can be calculated by dividing by the total number of pixels.

For example, for a colour image having dimensions of 260×240 pixels, there are 62400 pixels. If each pixel is provided with a 5-bit pixel luma value, then after converting the luma value into a decimal number, the luma value is between 0 and 31. For an example where an image in which every pixel is fully on, the luma value of each pixel would be set at 31. During a conventional calculation of an average luma value the running total of the luma values would be 1934400 for an image the size of 260×240 pixels (i.e., image size×luma value of each pixel=260×240×31). This running total value would cause an overflow of a regular 16-bit unsigned integer, which typically has a maximum value of 65535.

As such, to avoid such an overflow condition, the embodiment may use an average calculation that calculates a running average per equation 3:

$$A_N = A_{N-1} - \frac{A_{N-1} - X}{N} \quad \text{Equation 3}$$

Therein, $A_N$ is the new average, $A_{N-1}$ is the previous average, X is the new value added to the average, and N is the number of values included in the average so far.

In an exemplary display 14 in device 10, a colour format used is RGB 565, meaning that there are 32 levels of resolution for red in five bits, 64 levels for green in six bits and 32 levels for blue in five bits.

One method of obtaining RGB values having a same intensity range from RGB 565 is as follows: First, shift the 5 bit red value to the left by one digit and set the least significant bit (LSB) equal to the most significant bit (MSB). Next, repeat the shift for the 5 bit blue value. At this point, all three colours are in the range of between 0 and 63. Another conversion method (less preferred) is to drop the LSB of the green pixel, in order to normalize all bit values for the red, green, and blue colours.

Next, the values for the three colours are converted into a single luma value by a weighted calculation. The weighting of each pixel colour is based on the photopic curve. The human eye does not perceive all wavelengths of light equally: generally green wavelengths are perceived to be more intense than red and blue wavelengths. Therefore when converting a red-green-blue image to a pixel luma image, the green value in the image is preferably most heavily weighted. A commonly used (NTSC Standard) weighting is provided in Equation 4:

$$\text{Luma}=\text{PixelIntensity}=0.3\times\text{RED}+0.59\times\text{GREEN}+0.11\times\text{BLUE} \quad \text{Equation 4}$$

It can be seen that the green value is most heavily weighted with a scaling factor of 0.59, the red value is next most heavily weighted with a scaling factor of 0.3 and the blue value is least heavily weighted with a scaling factor of 0.11. In other embodiments, other scaling factors may be used.

Next, for section 404 the value of the luma is adjusted. Based on the luma value determined in section 402, one or more algorithms may be applied to adjust one or more of the intensities of the RGB colours for a given pixel. The luma value may be adjusted by a factor, having regard to the average luma value determined for the image. The average luma value would be in a range of expected luma values. If the luma is on the lower end of the scale, then there is more "headroom" to increase the average luma. That headroom may be utilized by scaling the luma value of each pixel (or one or more RGB colour components of each pixel) according to the headroom available. As the average luma implies that some pixels have a lower luma and others have a higher luma, the amount of headroom may be adjusted to compensate for the lower or higher luma values. Such adjustments may be provided using statistical distribution models (for example a Gaussian model). Additionally or alternatively the headroom may be based on the identified statistical (or other) boundaries from the calculated average. In short, the average luma value provides an initial benchmark from which adjustments to the luma values for the pixels may be based.

It will be appreciated that RGB values for a pixel in an image may be adjusted individually. Further, as noted, luma changes may be made to different colour values (R, G or B) depending on perceived luma values for each. It is preferable that the resulting image is more intense that the original, but that the resulting colours in the resulting image retain the same colour balance as the original image.

Once an adjustment is applied to the selected pixels in the image, the luma adjusted image may be generated on the display of the device. A gamma calculation may be applied when calculating the backlight setting to apply to a luma adjusted image. Generally, a gamma factor provides a luma adjustment since an incremental change in a pixel value is typically not linearly proportional to a change in actual luminance. Namely, if a pixel value is 127 and a gain of two is applied, then the output is not twice as bright. In fact, it is actually closer to being four times brighter. Gamma curves are plots of measured pixel brightness against pixel values. The brightness intensity for a pixel value has a parabolic-shaped curve.

However, in a backlight system a change in the backlight level (namely, a change in the LED PWM duty cycle) is nearly proportional to the actual luminance. In a backlight system where the LED driving DC current level is changed, the relationship between DC drive current level and actual luminance may not necessarily be linearly proportional. However, it does not necessarily follow the same proportionality characteristic of the gamma curve either.

As such, when calculating a backlight reduction to be applied to a given pixel gain, it is useful to apply gamma correction to the gain value. Equation 5 provides an exemplary correction equation, where backlightMax is the backlight setting that would be applied to an image with no pixel luma correction (i.e. pixelGain=1) and K2 and K3 are tuning factors to allow for system adjustments, where in a perfect system, K2=1 and K3=0.

$$NewBacklightSetting = BacklightMax \times K_2\left(\frac{1}{PixelGain}\right)^{gamma} + K_3 \quad \text{Equation 5}$$

Next, for section 406, based at least in part on the average luma value calculated an adjustment value is determined for the backlight. As the luma of the image has been boosted, the image will be brighter. As such, there is less need from a visibility point of view, to utilize the original backlight level for the original image. The backlight level may be turned down, thereby saving some battery power. It will be appreciated that from the original image, the increased pixel luma values used with the decreased backlight level will result in a comparably bright image as if the original image were generated on the display with the original backlight level. It will be appreciated that while an exact matching of perceived intensity (luminance) from the original image to the produced image is a target, there may be thresholds where a degree of deviation from the original luminance (either brighter or darker) is acceptable, in view of algorithms used. In addition, the adjusted backlight level may be maintained until a new adjustment is made for a different image, or maintained for a predetermined time.

Consideration for other factors may be used when adjusting the backlight level. For example, the backlight level may further be adjusted in view of a range of minimum and maximum brightness levels for backlight system 64 is provided in order to provide practical operational boundaries for the brightness level signals provided by backlight system 64. The boundaries may vary on the characteristics of each device 10 and each type of display 14 provided therein. Further, system 64 may also consider the ambient lighting determined in conjunction with the readings from light sensor(s) 66 when determining a brightness range.

Next at section 408, once all backlight parameters are set, the control signals can be activated to set the backlight level at the new level. Therein, all control signals for the backlight system 64 are provided by application 48G to backlight system (e.g. as a PWM signal or a duty cycle signal), and backlight system 64 provides a backlight intensity value that is lowered to account for the increased luma provided for the adjusted image.

Finally, at section 410, the adjusted image is sent to be generated on the display. The effect will be that the overall brightness (luminance) of the adjusted image (with backlight) will be comparable to the original image with the unadjusted backlight. However, as the new backlight level is lower than the original, power is conserved. At the same time, the image is written itself to display 14. It will be appreciated that the processes described in FIG. 3 may be executed in parallel, serial or different orders (to some extent). For example, steps 308 and 310 may be done independently or simultaneously in different orders.

FIG. 5 provides a pseudo-code listing which may be used as a basis to implement flow chart 400 in software. Briefly, for each pixel, the luma value is calculated by combining the intensity values of each colour through a weighted sum calculation and is added to the histogram data. Then, a calculation is made to determine the acceptable level at which to clip luma values. Then a pixel gain value is calculated and applied to the pixels in the image. Finally, an adjustment factor is determined for the backlight and applied to the backlight.

As long as an image remains generated on display 14, the backlight level preferably remains the same. The embodiment describes providing backlight calculations for images that are static on display 14. For video images, an embodiment can utilize the same techniques described herein on a frame-by-frame basis. Alternatively, for video applications, the backlight calculations may be done on an interval basis, for example, once every 2, 3, 5, 10, 15, 20, 30 . . . frames. This interval may be based on the video CODEC used. Many CODECs only contain complete frame data only for one frame in an interval. Subsequent frames in the interval are composites of these full-data frames. In an embodiment synchronization of the backlight adjustment with the display image update is provided. If a backlight adjustment occurs abruptly before or after the image is completely updated on the display, a change in display luma may be noticeable to the user. One solution is to adjust the backlight gradually (for example as a ramped function) from one level to another and/or synchronized with the display frame update (for example, synchronize with VSync signal).

It will further be appreciated that for an electronic device, several static images may be displayed on device 10, even though minimal activity is apparent on device 10. For example, for a device that has a moveable displayed cursor, each instance of a movement of the cursor would cause a new image to be generated on display 14. As such, a new calculation may be done for each updated image. Also, a display on device 14 having a clock graphic would be updated each time a digit changed on the clock graphic. Another example of similar minor changes on display 14 is the appearance/disappearance of RF transmit/receive overlay icons that appear/disappear based on RF activity. For such instances, if the change in the image affects only a relatively small portion of the entire screen (for example, if the change is in a portion that represents less than about 35% of the screen) or is localized to a predefined region of the screen, the system may selectively not conduct a recalculation of the luma of the image. A predefined region may be of any size and any location in display 14. For example, a predefined region may be where clock information is generated on display 14 or another area where "minor" updates to images or information is frequently provided to display 14.

The embodiment described herein provides luma calculations based on the entire display section of display 14. In other embodiments, different sections of display 14 may be used to calculate an average. For example, an average may be calculated based on alternating rows in display 14 or on a specific section of display 14 (e.g. its central area). Other averages may use only one or two of the colours (e.g. green and red, as they are the two most dominant colours). In other embodiments a combination of any of these alternative calculations may be used. It is also possible to sample a reduced number of pixels from the image, for example where a histogram is calculated on every nth pixel (n greater than 1). Additionally or alternatively, periodic sampling, random or pseudo-random sampling may be used to select a set of pixels for luma measurement.

It will be appreciated that the embodiment can be used on monochrome displays. Therein, a greyscale value is provided for the image being displayed on display 14. In this case the greyscale value will be equivalent to the luma value.

It will be appreciated that other luma or intensity calculations may be utilized by an embodiment. For example, an intensity calculation may be provided for other images, such as a YUV color encoding image, a JPEG file and an MPEG file, using macro block luminance. Further detail is provided below.

In a macroblock calculation, pixels that are grouped into a predetermined area or region (herein referred to as a macroblock) may be coded together, to determine one intensity value that will be applied to all pixels in that macroblock. The size and location of a macroblock may be set to be any area in display 14. A macroblock may be located in the center of display 14, may be located at a bottom, top, or side portion of display 14 and may be any predetermined size. The size may be viewed as a percentage of the entire area of display 14. An area may be any value between 1% to 99% of the display 14. In lossy codecs, such as JPEG and MPEG, the macroblocks may be subjected to an inverse discrete cosine transform (IDCT) to convert the pixel YUV data into frequency data. The (0,0) element in the transformed macroblock may be used to represent the discrete cosine component of the macroblock, which corresponds to the overall brightness of every pixel in the macroblock. As such, it is possible to change the overall brightness of all the pixels in the macroblock by adjusting that single discrete cosine component.

When the macroblock is transformed from the frequency domain back to YUV, the brightness change to the discrete cosine component will be reflected. This may significantly reduce the amount of processing required to do the type of image/backlight adjustment by leveraging commonalities in adjacent pixels.

By the nature of JPEG and MPEG encoding, commonalities have already been identified when the macroblocks were created. This allows for finer adjustment as a non-uniform adjustment can be made with macroblock accuracy. It is possible that the adjustment may only be necessary on the Y channel.

If a image file type does not use macroblocks to group its data, a macroblock may be introduced to the data. Then a spatial transform may be applied when the image is rendered.

For example, if a non-macroblocked bitmap is to be displayed from memory, the following processes may be executed:

[Get Bitmap Image Data]

[Convert data RGB to YUV data]

[Perform Macroblock grouping and YUV data to frequency data conversion]

[Apply image/backlight adjustment on macroblocks]

[Convert frequency data to YUV data]

[Convert YUV data to RGB data ]

Because still images are typically not updated as frequently as video images, the processing cost of these extra processing steps may be acceptable. Also, algorithms used for the colour space conversion, such as the conversions between YUV data and Frequency data, are often accelerated in hardware. It will be appreciated that in JPEG/MPEG macroblocks, since data is already grouped into macroblocks and is stored in frequency data, the RGB data to YUV data and the YUV data to frequency data conversions may be skipped. It will also be appreciated that a luma conversion is inherent provided in a RGB data to YUV data conversion as the Y channel itself is luma.

In other embodiments, the intensity calculation provided above can be used with ambient lighting condition information provided by sensor 66 to make further adjustments to the intensity level. One or both of the intensity value and the backlight level may be adjusted per such lighting conditions.

Figure 6:
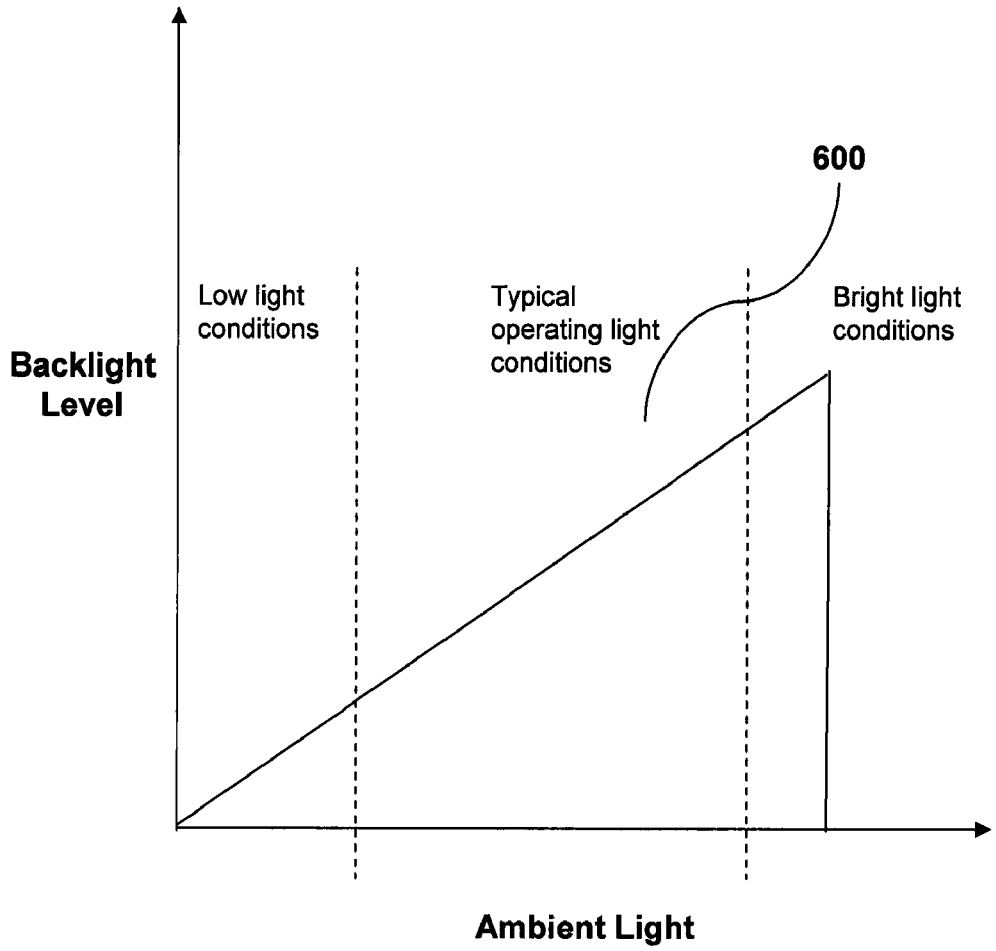
FIG. 6 is a graph illustrating a backlight intensity level for various ambient lighting conditions used by an embodiment of FIG. 1.

For example, referring to FIG. 6 graph 600 shows a backlight level for display 14 on the y-axis compared against a level of ambient light surrounding device 14 on the x-axis. As is shown, graph 600 has in a low backlight level when display 14 is in a very dark environment. As such, at low ambient light conditions (determined by one or more preset thresholds), the backlight may simply be set at a lower value and the image intensity adjustments may or may not be conducted. As the amount of ambient light increases, the backlight level increases as well. In a "typical" operational ambient light environment, the image intensity calculations and adjustments as described for FIG. 4 may be conducted. Graph 600 provides a linear increase in backlight level intensity to as the amount of ambient light increases. At a certain point, the ambient light conditions are very bright and the backlight may be turned brighter. In some instances, the adjustment values for the intensity of the image and the backlight may not be done at all and the backlight may simply be turned off. An embodiment may adjust the intensity calculations and/or the backlight level depending on the amount of ambient light detected. Alternatively the intensity of the image may still be adjusted, but the backlight is still not activated. This would save some processing steps. It will be appreciated that in other embodiments for other LCDs, other graphs of backlight level progressions may be used, including step-wise progressions and non-linear progressions. A backlight level progression may be expressed as a formula, which may be used by software to determine an appropriate control signal for the controller of the backlight system for a given level of ambient light. In other embodiments, a backlight level progression may be stored as a table providing a set of backlight levels for a corresponding set of ambient light levels. In other embodiments, a series of different adjustment algorithms may be used.

In other embodiments, calculations may be processed more quickly using alpha masking/blending (overlays), which may leverage graphics processing hardware acceleration. An overlay may be used to apply a gain value to a whole frame of image data at once. One overlay technique would create an overlay image (which may be the same size as a full frame) based on the gain value that is to be applied. The overlay may be applied using a (hardware) acceleration routine for alpha masking/blending. The result is that the overlay image will be "mixed" with the image in the frame buffer, thereby achieving the same or substantially similar intensity adjustment effect as multiplying each RGB pixel by the gain on a pixel-by-pixel basis.

It will be appreciated that the embodiments may be provided in a device that has multiple displays where separate intensity adjustments are made for each display.

It will be appreciated that the embodiments relating to devices, servers and systems may be implemented in a combination of electronic hardware, firmware and software. The firmware and software may be implemented as a series of processes and/or modules that provide the functionalities described herein. Interrupt routines may be used. Data may be stored in volatile and non-volatile devices described herein and be updated by the hardware, firmware and/or software. Some of the processes may be distributed.

As used herein, the wording "and/or" is intended to represent an inclusive-or. That is, "X and/or Y" is intended to mean X or Y or both.

The present invention is defined by the claims appended hereto, with the foregoing description being merely illustrative of a preferred embodiment of the invention. Those of ordinary skill may envisage certain modifications to the foregoing embodiments which, although not explicitly discussed herein, do not depart from the scope of the invention, as defined by the appended claims.

The invention claimed is:

1. A system for an electronic device for adjusting images, comprising:

a display for displaying an image on the device;

an image adjustment module to convert bitmap data for the image from RGB data to YUV data;

convert YUV data of a macroblock of the image being no greater than 99% of the size of the image to frequency data using an inverse discrete cosine transform;

adjust a discrete cosine component of a pixel in the macroblock to adjust the brightness of all pixels in the macroblock based on a distribution of intensities of pixels in the macroblock;

further adjust the discrete cosine component of the pixel in the macroblock by a percentage of the distribution based on a clip level for the distribution or a standard deviation value for the distribution;

convert the frequency data to adjusted YUV data; and convert the adjusted YUV data to adjusted RBG data for the image having new pixel intensity values; and a backlight system to provide a backlight for the display, the backlight system responsive to the image adjustment module based on the new pixel intensity values, the backlight being decreased by a factor relating to a gamma factor associated with the image.

2. The system for an electronic device as claimed in claim 1, wherein the backlight is maintained for the display for a predetermined length of time.

3. The system for an electronic device as claimed in claim 1, wherein the backlight is maintained for the display after a different image is provided to the display.

4. The system for an electronic device as claimed in claim 1, wherein the new pixel intensity values represent an average pixel intensity of the image, the average intensity is calculated from original pixel intensity values associated with the image.

5. The system for an electronic device as claimed in claim 1, wherein:

the new pixel intensity values represent an average intensity of the image;

the average pixel intensity is calculated on a running average basis of pixels in the image;

the image is a first image;

identified pixel intensity values are first identified intensity values for the image;

the new pixel intensity values are first new pixel intensity values, and the image adjustment module is further configured to identify second pixel intensity values of a second image, determine second pixel intensity values for the second image based in part on the second intensity values, provide the second image at the second intensity pixel values to the display, and determine a second backlight for the second image using the second intensity values.

6. The system for an electronic device as claimed in claim 5, wherein the first image and the second image are frames in a video signal.

7. The system for an electronic device as claimed in claim 1, further comprising:

a light sensor configured to generate an electrical signal as a function of detected light, wherein the image adjustment module is further configured to determine at least one the new pixel intensity values or the backlight as a function of the electrical signal.

8. The system for an electronic device as claimed in claim 1, wherein a gain factor is applied to the image using an overlay.

9. The system for an electronic device as claimed in claim 1, wherein the image adjustment module determines the new pixel intensity values using new luma values based at least a portion of the distribution of intensities of pixels in the macroblock.

10. The system for an electronic device as claimed in claim 9, wherein the image adjustment module uses data from a histogram to calculate the distribution of intensities of pixels in the macroblock.

11. The system for an electronic device as claimed in claim 1, wherein the image adjustment module:

utilizes a gain factor to determine the new pixel intensity values, the gain factor being based on the maximum pixel value in the distribution of intensities of pixels in the macroblock;

analyzes the distribution of intensities of pixels in the macroblock to identify a value for the gain factor; and clips the new pixel intensity values at up to a maximum percentage in the image when the gain factor is applied to them.

12. The system for an electronic device as claimed in claim 1, wherein the macroblock is located in one of the center, bottom, top or side portion of the display.

13. The system for an electronic device as claimed in claim 1, wherein the gamma factor relates to a luma value associated with the new pixel intensity values.

14. A method of adjusting a backlight for a display for an electronic device, comprising:

converting bitmap data for an image to be generated on the display from RGB data to YUV data;

for an area of the image defined as a macroblock being no greater than 99% of the size of the image converting YUV data of the macroblock to frequency data using an inverse discrete cosine transform;

adjusting a discrete cosine component of a pixel in the macroblock to adjust the brightness of all pixels in the macroblock based on a distribution of intensities of pixels in the macroblock; and further adjusting the discrete cosine component of the pixel in the macroblock by a percentage of the distribution based on a clip level for the distribution or a standard deviation value for the distribution;

converting the frequency data to adjusted YUV data;

converting the adjusted YUV data to adjusted RBG data for use in generating the image at new intensity values in the display;

determining a backlight level for the image using the new intensity values; and providing the backlight level to a backlight system for a display when the image is generated on the display, wherein at least one of the new intensity values and the backlight level is adjusted to account for ambient light conditions of the electronic device; and the backlight level is determined from a gamma-adjusted intensity gain calculation for the image.

15. The method of adjusting a backlight for a display for an electronic device, as claimed in claim 14, wherein the macroblock is located in one of the center, bottom, top or side portion of the display.

16. The method of adjusting a backlight for a display for an electronic device, as claimed in claim 14, wherein the gamma-adjusted intensity gain calculation relates to a luma value associated with the new intensity values.

* * * * *